United States Patent [19]

Favrot

[11] 4,274,229

[45] Jun. 23, 1981

[54] FRAMES OF GRINDING MACHINES

[75] Inventor: Paul Favrot, Gagny, France

[73] Assignee: Constructions de Clichy, France

[21] Appl. No.: 961,681

[22] Filed: Nov. 17, 1978

[30] Foreign Application Priority Data

Nov. 22, 1977 [FR] France ..... 77 34988

[51] Int. Cl.[3] ..... B24B 5/02; B24B 55/02

[52] U.S. Cl. ..... 51/95 WH; 51/103 C; 51/105 R; 51/166 R; 51/267

[58] Field of Search ..... 51/95 R, 95 WH, 103 R, 51/105 R, 166 R, 236, 267, 270, 356, 237 R, 424, 103 C

[56] References Cited

U.S. PATENT DOCUMENTS

| | | | |
|---|---|---|---|
| 626,337 | 6/1899 | Norton | 51/95 WH |
| 1,235,232 | 7/1917 | Norton | 51/95 R |
| 2,110,441 | 3/1938 | Kasch | 51/267 |
| 2,175,347 | 10/1939 | Granberg et al. | 51/267 |
| 2,267,250 | 12/1941 | Mossdorf | 51/95 WH |
| 2,626,492 | 1/1953 | Balsiger | 51/236 |
| 3,152,426 | 10/1964 | Arneson | 51/267 |
| 3,553,895 | 1/1971 | Power | 51/424 |

FOREIGN PATENT DOCUMENTS 18638 of 1914 United Kingdom ..... 51/237 R

*Primary Examiner*—Harold D. Whitehead
*Assistant Examiner*—K. Bradford Adolphson
*Attorney, Agent, or Firm*—George H. Gerstman; Garrettson Ellis

[57] ABSTRACT

The grinding machine comprises a frame having an upper portion in the form of a stationary table for supporting a grinding-wheel carriage, and a bed provided with slideways for supporting the headstock and tailstock between which is mounted the workpiece to be ground. In order to facilitate drainage of water from the surfaces of the machine, the top uncovered edge surfaces of the bed are downwardly inclined towards the interior of the bed in which ducts are provided for collecting the water within a discharge chute.

2 Claims, 3 Drawing Figures

FRAMES OF GRINDING MACHINES

BACKGROUND OF THE INVENTION

This invention relates to a grinding machine comprising a frame having an upper portion in the form of a stationary table for supporting a grinding-wheel carriage, and a bed provided with slideways in the upper portion thereof in order to support a movable table for carrying the headstock and tailstock between which is mounted the workpiece to be ground.

In known machines of this type, the top face of the bed is horizontal and the stationary table is often horizontal as well. As a consequence, this gives rise irremediably to the formation of large puddles produced by the water employed for cooling the grinding-wheel and the workpiece. In point of fact, these puddles of water contain a not-negligible quantity of abrasive particles which become detached from the grinding-wheel. In a very short time, these particles result in the formation of a veritable cement which is very hard and can be removed only by means of a chisel, thus clearly constituting a major drawback.

SUMMARY OF THE INVENTION

The aim of the invention is to remove this disadvantage. Accordingly, since the table is already inclined downwards and towards the bed which carries the movable table (and preferably at an angle of the order of 20°), the uncovered top edge surfaces of the bed are also downwardly inclined towards the interior of the bed which is accordingly provided with ducts for collecting the water in a chute.

By virtue of this particular structure, the water is evacuated, not only from the stationary table but also from the bed progressively as it is deposited thereon, while at the same time maintaining a permanent flow which is intended to carry away all the abrasive particles which the water may contain. The formation of solid deposits mentioned earlier is thus radically suppressed.

BRIEF DESCRIPTION OF THE DRAWINGS

A clearer understanding of the invention will be gained from the following description and from the accompanying drawings in which one embodiment of an improved production grinding machine in accordance with the invention is shown by way of example, and in which.

DETAILED DESCRIPTION OF THE INVENTION

Figure 1:
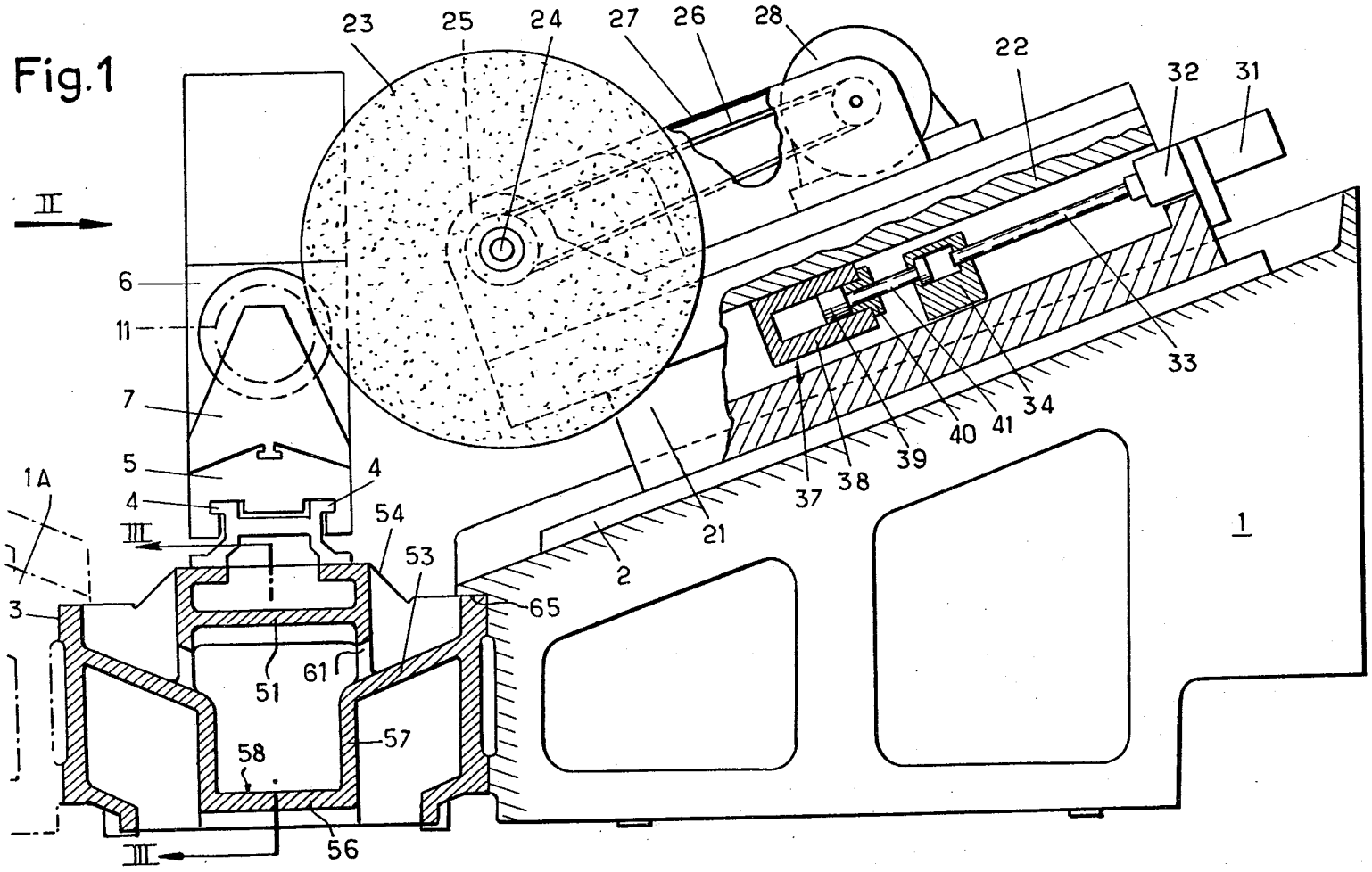
FIG. 1 is a part-sectional profile view of the complete grinding machine looking in the direction of the arrow I of FIG. 2, a cross-section being taken through the bed along line I—I of FIG. 3.
Figure 2:
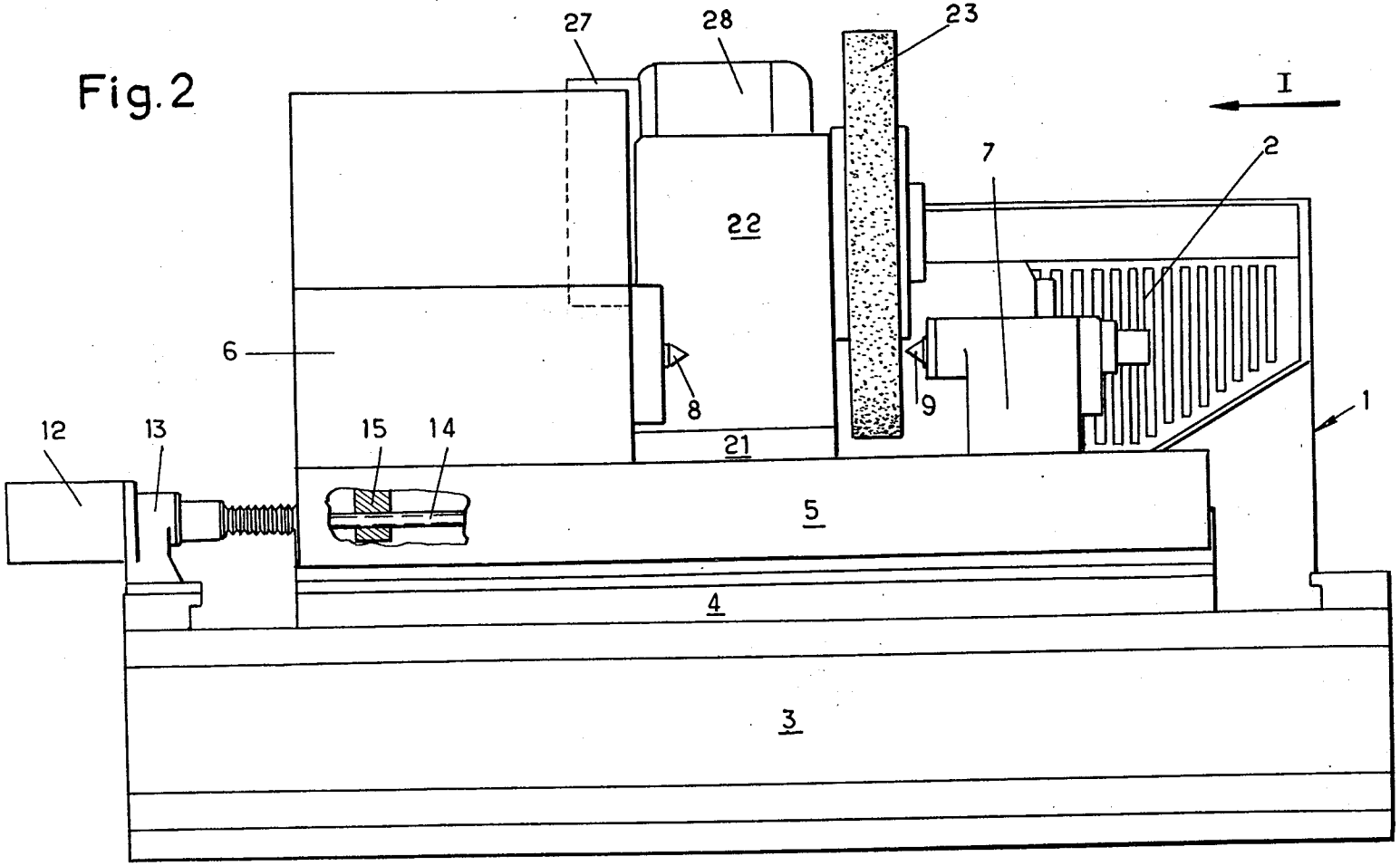
FIG. 2 is a corresponding front view.

The production grinding machine which is generally illustrated in FIGS. 1 and 2 essentially comprises a frame 1 so designed that the upper portion of the frame forms a stationary table 2 which is downwardly and forwardly inclined through an angle of approximately 20°, and a bed 3 provided in the upper portion thereof with slideways 4 for supporting a movable table 5 which carries the headstock 6 and the tailstock 7. Said headstock and tailstock are provided respectively with centers 8 and 9 between which the workpiece 11 to be ground can be mounted. The table can be displaced along its slideways by means of a drive system comprising a stepping motor 12 having two directions of rotation and carried by the bed 3, a reduction-gear unit 13, and a screw 14 engaged with a nut 15 which is rigidly fixed to the table 5.

On the stationary table 2 is bolted a slide plate 21 which supports a grinding-wheel carriage 22. The grinding-wheel 23 is rigidly fixed to a shaft 24 which is rotatably mounted in bearings 25 of the upper portion of the carriage and is driven in rotation by means of a belt 26 protected by a housing 27 from an electric motor 28 which is also carried by the carriage 22.

The grinding-wheel carriage 22 can be displaced along the slide plate 21 by means of a drive system comprising an electric stepping motor 31 carried by the slide plate 21 and equipped with a reduction-gear unit 32, a screw 33 coupled to the output shaft of the reduction-gear unit, a nut 34 engaged on the screw 33 and slidably mounted on the plate 21 without being capable of rotating about its own axis, and a hydraulic jack 37, the jack cylinder 38 being rigidly fixed to the grinding-wheel carriage 22 and the jack piston 39 being connected to the nut 34 by means of a rod 41 extended through end top 40 closing the cylinder 38.

Figure 3:
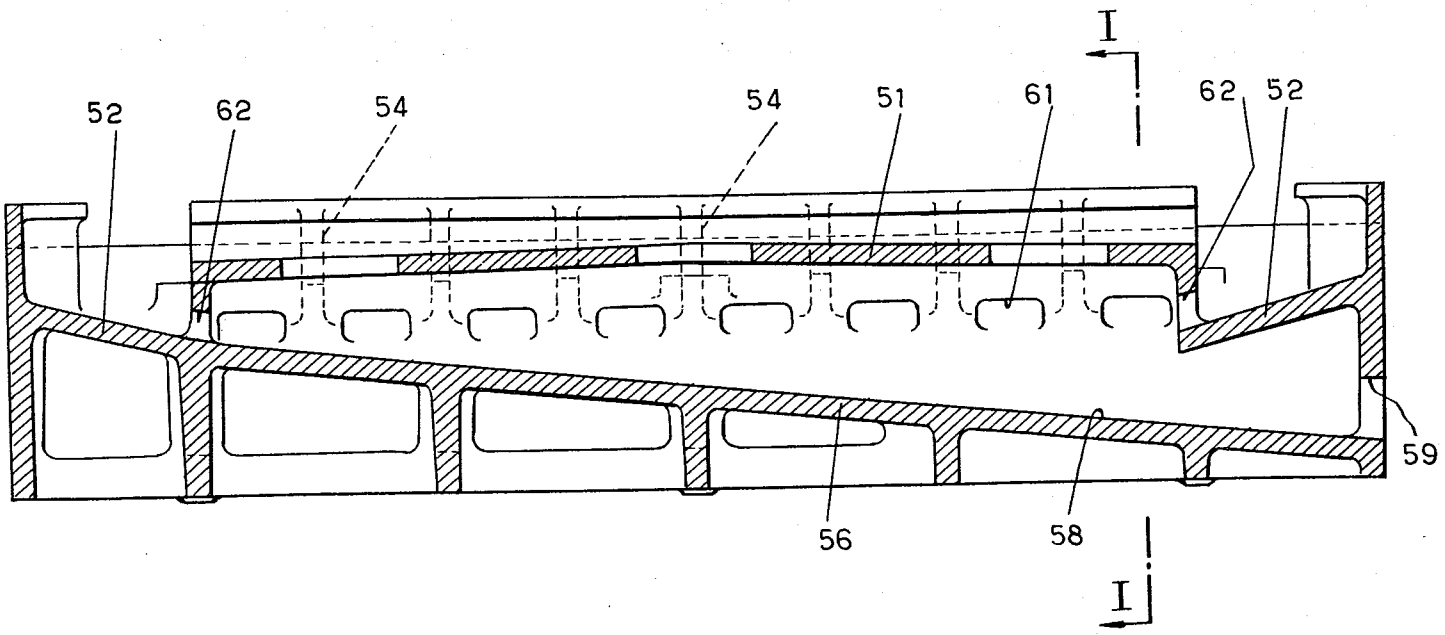
FIG. 3 is a longitudinal sectional view of the bed, this view being taken along line III—III of FIG. 1.

The bed 3 is symmetrical with respect to its vertical longitudinal mid-plane which passes through the section line III—III of FIG. 1. Practically all the bed surfaces which are directed upwards are inclined in order to facilitate drainage of surface water. For example, the top web 51 (also shown in FIG. 3) has two faces which slope downwards to the ends of the bed, and, in turn carries slideways 4. The two ends webs 52 are inwardly inclined. The two side webs 53 are also inwardly inclined, extending between front edge 65 of the stationary table and vertical walls 57, while provision is made for sloping transverse top ribs 54. Lower interior web means include a large web 56 extending within the interior of the bed over the entire length of the bed to form, in conjunction with added lower interior web means comprising vertical longitudinal internal walls 57, a chute 58 for the recover of all water which falls onto the bed. Said chute terminates at one end of the bed in a rectangular opening 59. A communication is provided by the openings 61 between the top faces of the sloping longitudinal webs 53 and the chute 58 whilst two end openings 62 also establish a communication between the top faces of the webs 52 and said chute. One of the longitudinal edges of the top face of the bed is fitted beneath a front edge 65 of the stationary table 2 so as to ensure that the entire quantity of water which flows off said table is collected by the bed and also evacuated through the chute 58 but can be recovered at the outlet of this latter if necessary. The bed 3 is rigidly fixed to the frame 1, for example by means of bolts (not shown in the drawings). By reason of the symmetrical character of the bed, the user is given the possibility of mounting this latter in either one direction or in the other, depending on whether it is desired to place the chute outlet 59 either on one side of the machine or on the other.

On the other side of the bed 3, there can be placed another frame 1A which supports another grinding unit in order to form a double machine which is capable of working on both sides of the workpiece 11 to be ground.

The operation of the machine is as follows:

The position of the grinding-wheel carriage 22 on the slide plate 21 is accurately adjusted by means of the reduction-gear stepping motor 31 which causes the nut 34 to move along the slide plate 21. Under the action of gravity or in other words without having recourse to any means for taking up play, the grinding-wheel carriage 22 tends to move downwards as far as possible towards the work-table 5 and is retained by the piston 39 against which the top end 40 of the cylinder 38 of the hydraulic jack 37 is abuttingly applied, said piston being in turn retained by the rod 41 and this latter being rigidly fixed to the nut 34 which is engaged on the screw 33. If oil is admitted under pressure into the top chamber of the jack 37, the cylinder 38 is displaced upwards and accompanied by the grinding-wheel carriage in order to move the grinding-wheel away from the workpiece. If said chamber is connected to the drain tank, the grinding-wheel carriage returns strictly to its work position. During the grinding operation, the hydraulic jack 37 is in the rest position. In other words, oil under pressure is not fed into the jack and this latter is consequently not liable to transmit to the grinding-wheel any vibrations of the oil delivery pump.

The fact that the arrangement hereinbefore described ensures permanent and efficient drainage of water need not be dwelt upon any further since these advantages have already become apparent from the foregoing description.

It will also be understood that the invention is not limited in any sense to the embodiment which has been described with reference to the accompanying drawings. Depending on the applications which are contemplated, the invention can be extended to many alternative forms within the capacity of those who are versed in the art, without thereby departing either from the scope or the spirit of the invention.

I claim:

1. A production grinding machine for finishing a workpiece, the combination of a frame defining an upper stationary table having inclined slideways which terminate at a lower front edge of the stationary table;

a carriage, means supporting the carriage on the ininclined slideways of the stationary table, and means operable to move the carriage toward and away from the front edge, a grinding-wheel and means mounting the grinding-wheel rotatably on the carriage, an elongated bed disposed along the front edge of the stationary table, said bed having a medial upper portion provided with slideways, and a movable table supported to move along the bed on the slideways, a headstock and a tailstock carried respectively on the movable table and operable for supporting the workpiece, said bed being hollow below said slideways and having top web means extending laterally from opposite sides of the slideways and terminated at side webs, and the side webs being terminated adjacent lower interior web means operable to define an interior chute positioned to receive flow from said side webs;

the top web means being provided with opening means in communication with the chute, and said side webs defining duct means therein to establish communication from above the top webs to the chute;

the top and interior web means further being inclined, and opening means at the lower end of the chute forming an outlet, and said stationary table front edge positioned in flow communication with the bed chute, whereby free-flowing paths are defined for carrying coolant liquid applied onto the grinding-wheel and draining therefrom and off the stationary table via the outlet and away from the grinding machine.

2. A production grinding machine according to claim 1, wherein said bed has a vertical longitudinal midplane through the medial upper portion, and wherein the bed is symmetrical with respect to said plane.

* * * * *